US006315536B1

(12) United States Patent
DeVore et al.

(10) Patent No.: US 6,315,536 B1
(45) Date of Patent: Nov. 13, 2001

(54) SUCTION INLET SCREEN AND FUNNEL FOR A COMPRESSOR

(75) Inventors: Todd DeVore, Wapakoneta; Jeff Huddleston, Sidney, both of OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/443,203

(22) Filed: Nov. 18, 1999

(51) Int. Cl.[7] ..... F01C 1/04; F01C 21/04; B01D 50/00

(52) U.S. Cl. ..... 418/55.6; 418/100; 418/DIG. 1; 55/320; 55/327; 55/331

(58) Field of Search ..... 418/55.6, 100, 418/DIG. 1; 55/320, 327, 331, 332, 462

(56) References Cited

U.S. PATENT DOCUMENTS

| | | | |
|---|---|---|---|
| 4,260,402 | 4/1981 | Schaffer et al. | 55/505 |
| 4,340,339 | 7/1982 | Hiraga et al. | 418/88 |
| 4,547,138 | 10/1985 | Mabe et al. | 418/55.6 |
| 4,551,081 | 11/1985 | Sato et al. | 418/55.1 |
| 4,648,814 | 3/1987 | Shiibayashi | 418/55.6 |
| 4,900,238 | 2/1990 | Shigemi et al. | 418/149 |
| 5,110,268 | 5/1992 | Sakurai et al. | 418/55.6 |
| 5,222,885 | 6/1993 | Cooksey | 418/96 |
| 5,330,335 | 7/1994 | Teracuhi et al. | 418/55.6 |
| 5,346,376 | 9/1994 | Bookbinder et al. | 418/55.4 |
| 5,358,392 | 10/1994 | Ukai | 418/55.6 |
| 5,456,584 | * 10/1995 | Isomura et al. | 418/55.1 |
| 5,520,524 | 5/1996 | Takemoto et al. | 418/55.5 |
| 5,545,020 | 8/1996 | Fukanuma et al. | 418/55.4 |
| 5,580,228 | 12/1996 | Ishikawa et al. | 418/55.2 |
| 5,645,408 | 7/1997 | Fujio et al. | 418/55.6 |
| 5,678,986 | 10/1997 | Terauchi et al. | 418/55.6 |
| 5,807,089 | 9/1998 | Tsumagari et al. | 418/55.3 |

FOREIGN PATENT DOCUMENTS

| | | | |
|---|---|---|---|
| 4422314 | * 12/1994 | (DE) | 418/55.6 |
| 0518356 | * 12/1992 | (EP) | 418/55.6 |
| 63-183284 | * 7/1988 | (JP) | 418/55.6 |

* cited by examiner

*Primary Examiner*—John J. Vrablik
(74) *Attorney, Agent, or Firm*—Harness, Dickey & Pierce, P.L.C.

(57) ABSTRACT

A horizontal open drive scroll machine has a lubrication removal system located with the suction inlet of the scroll machine's outer housing. The lubrication removal system includes a funnel which directs the incoming working fluid to a position radially inward from the suction inlet defined by the scrolls. A fine mesh screen is located within the suction inlet of the housing to further aid in the removal of the lubricant from the working fluid being returned to the suction pressure chamber of the scroll machine.

10 Claims, 2 Drawing Sheets

SUCTION INLET SCREEN AND FUNNEL FOR A COMPRESSOR

FIELD OF THE INVENTION

The present invention relates to open drive scroll machines. More particularly, the present invention relates to compressors which are exteriorly driven and which incorporate a unique suction inlet screen for the open drive scroll machine.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate scroll members having a pair of intermeshed spiral wraps, one of which is caused to orbit relative to the other so as to define one or more moving chambers which progressively decrease in size as they travel from a radially outer suction port toward a radially inner or center discharge port. Some type of power unit is provided which operates to drive the orbiting scroll member via a suitable drive shaft. The bottom or lower portion of the housing which contains the scroll members normally contains an oil sump for lubrication of the various moving components of the compressor.

Scroll machines can be separated into two categories based upon the positioning of the power unit which drives the scroll member. The first category is scroll machines which have the power unit located within the housing or shell along with the scroll members. The housing or shell containing the power unit and the scroll members can be open to the environment or it can be sealed to provide a hermetic scroll machine wherein the housing or shell also contains the working fluid to be compressed by the scroll machine. The second category of scroll machines is scroll machines which have the power unit separate from the housing containing the scroll members. These machines are known as open drive scroll machines and the housing which contains the scroll members is normally sealed from the environment such that the housing contains the scroll members and the working fluid being compressed by the scroll members. The power unit for these open drive scroll machines can be provided by a drive belt and a pulley system, a gear drive system, a direct drive system or any other type of drive system.

Each of the above two categories of scroll machines can be further subdivided into two additional categories. These two categories would be scroll members which rotate on a vertical axis and scroll members which rotate on a horizontal axis. Hermetic compressors with the power unit within the housing or shell are the most popular type of compressors with the rotation axis of the scroll members positioned vertically. Open drive type of scroll machines which have the power unit exterior to the hermetic shell are the most popular type of compressors with the rotational axis of the scroll members positioned horizontally. Both the compressors having the rotational axis of the scroll members positioned vertically and horizontally have similar issues and/or problems which must be addressed. One of these common problems is to control the amount of lubricant which is ingested by the suction port defined by the scroll members.

During the operation of the scroll machine, the lubricant is distributed to the various moving components of the compressor. In a compressor where most of the moving components are located within the suction chamber of the compressor, the lubricant in mist form is usually present throughout the suction chamber. The scroll members ingest the working fluid into their suction port along with a certain amount of the lubricant in mist form. The working fluid and lubricant are compressed by the scroll members and delivered through a discharge outlet to the components which make up the system using the compressed working fluid. Once the system has utilized the compressed working fluid, it is returned to the hermetic housing or shell through a suction inlet. Prior to allowing the scroll members to ingest this returned working fluid, it is necessary to remove the lubricant which is entrained within the returned working fluid.

Various systems including screen and deflectors have been developed in order to trap or remove the lubricant from the returned working fluid. While these screens and deflectors have met with some success in removing the entrained lubricant, the continued development of scroll machines includes the development of systems designed to remove the entrained lubricant from the returned working fluid.

The present invention provides the art with a unique system which removes lubricant from the working fluid being returned through the suction inlet. The unique system of the present invention comprises a fine meshed generally spherical screen which is located on an enlarged inlet of a funnel. The funnel is located at the suction inlet of the compressor and it is designed to direct the returning working fluid to a position radially inward from the suction inlet of the scroll members. The funnel allows for the gathering of the lubricant from the fine meshed screen and the delivering of the lubricant along with the returned working fluid to a position where it is directed against the main bearing housing of the compressor. The directing of the gathered lubricant and the working fluid against the stationary main bearing housing limits the ability of the working fluid to again entrain the removed lubricant as well as further assisting in the removing of entrained lubricant from the working fluid due to its contact with the stationary main bearing housing.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
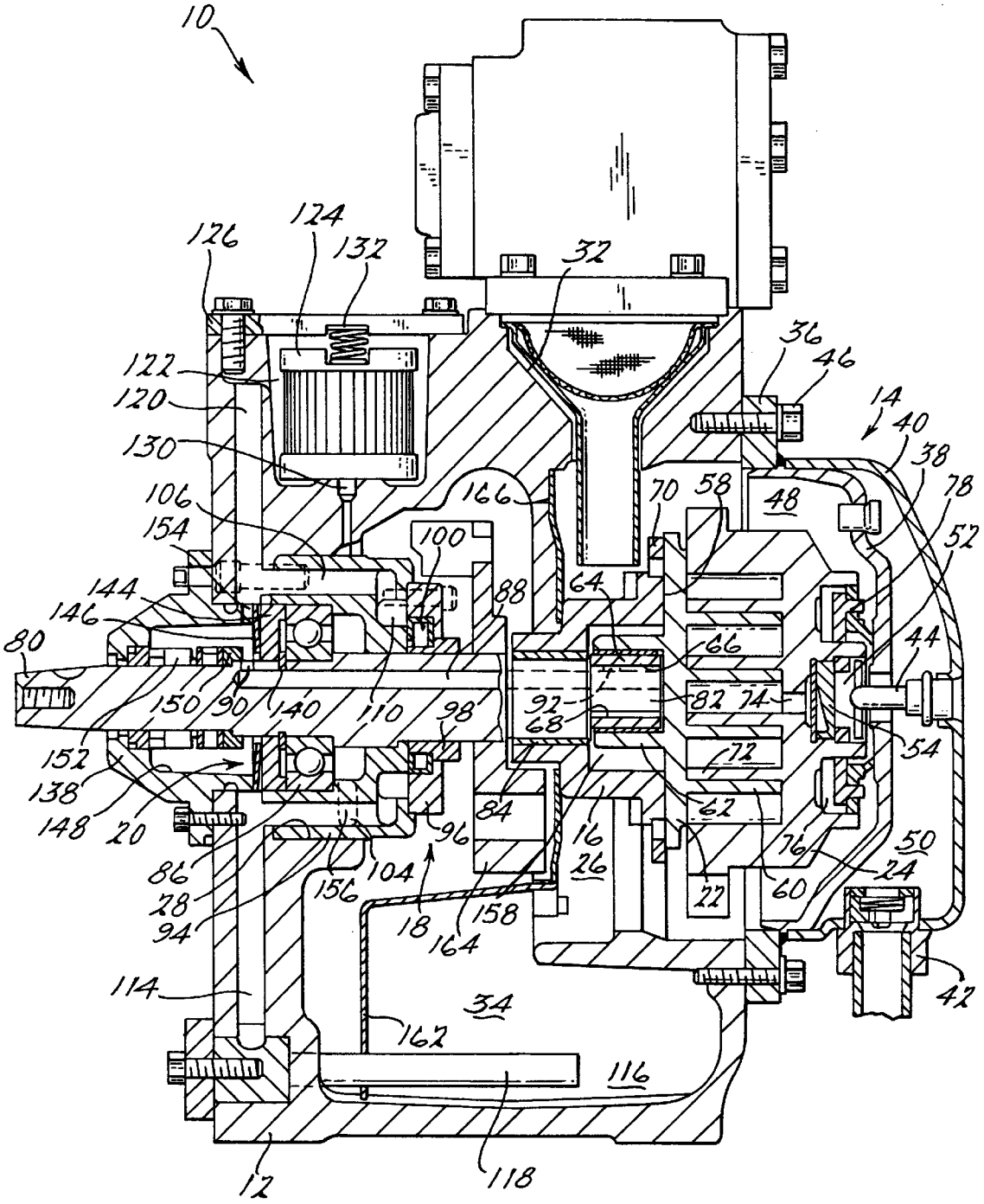
FIG. 1 is a vertical cross-section of an open drive horizontal scroll machine incorporating the unique lubricant removal system in accordance with the present invention.

Referring now to the drawings in which like reference numerals designate like or corresponding parts throughout the several views, there is shown in FIG. 1, an open drive horizontal scroll compressor which incorporates the unique lubricant removal system in accordance with the present invention and which is designated generally by the reference numeral 10. Compressor 10 comprises a compressor body 12, a cap assembly 14, a main bearing housing 16, an oil pump assembly 18, a lower bearing assembly 20, an orbiting scroll member 22 and a non-orbiting scroll member 24. While the unique lubricant removal system of the present invention is being disclosed within an open drive horizontal compressor, it is within the scope of the present invention to utilize the lubricant removal system of the present invention in a vertical open drive compressor as well as both a horizontal and vertical compressor having the power unit within the housing or shell.

Compressor body 12 is a generally cup shaped member, preferably from aluminum defining an internal cavity 26 within which is located main bearing housing 16, an internal bore 28 for mating with oil pump assembly 18 and lower bearing assembly 20 and a suction inlet 32 for mating with the refrigeration circuit associated with compressor 10. Compressor 10, body 12, cap assembly 14 and lower bearing assembly 20 define a sealed chamber 34 within which scroll member 22 and 24 are disposed.

Cap assembly 14 comprises an adapter plate 36, a partition 38, a cap 40, a discharge fitting 42 and a temperature probe 44. Adaptor plate 36 is secured to compressor body 12 using a plurality of bolts 46. Partition 38 is welded about its periphery to adaptor plate 36 at the same point that cap 40 is welded to partition 38. Partition 38 separates chamber 34 into a suction zone 48 and a discharge zone 50. Discharge fitting 42 extends through cap 40 and it provides a discharge gas outlet from discharge zone 50 to the refrigeration circuit associated with compressor 10. Temperature probe 44 extends through cap 40 and partition 38 such that it is located within a discharge recess 52 located within non-orbiting scroll member 24. A dynamic discharge valve assembly 54 is located within discharge recess 52 and it is retained within recess 52 by a retainer threadingly received or otherwise secured within recess 52.

Main bearing housing 16 includes a plurality of radially extending arms which are press fit into cavity 26 of compressor body 12. Main bearing housing 16 is provided with a flat thrust bearing surface 58 against which is located orbiting scroll member 22 which is manufactured from iron and which has the usual spiral vane or wrap 60. Projecting opposite to wrap 60 is a cylindrical hub 62 having a journal bearing 64 in which is rotatively disposed a drive bushing 66 having an inner bore 68. An Oldham coupling 70 is also provided positioned between orbiting scroll member 22 and bearing housing 16. Oldham coupling 70 is keyed to orbiting scroll member 22 and non-orbiting scroll member 24 to prevent rotational movement of orbiting scroll member 22. Oldham coupling 70 is preferably of the type disclosed in assignee's U.S. Pat. No. 5,320,506, the disclosure of which is hereby incorporated herein by reference.

Non-orbiting scroll member 24 is also manufactured from iron and is also provided with a wrap 72 positioned in meshing engagement with wrap 60 of orbiting scroll member 22. Non-orbiting scroll member 24 has a centrally disposed passage 74 which communicates with discharge recess 52 through discharge valve assembly 54 which is in turn in communication with discharge zone 50 defined by cap 40 and partition 38. An annular recess 76 is also formed in non-orbiting scroll member 24 within which is disposed a seal assembly 78. Recesses 52 and 76 and seal assembly 78 cooperate to define axial pressure biasing chambers which receive pressurized fluid being compressed by wraps 60 and 72 so as to exert an axial biasing force on non-orbiting scroll member 24 to thereby urge the tips of respective wraps 60 and 72 into sealing engagement with the opposed end plate surfaces. Seal assembly 78 is preferably of the type described in greater detail in U.S. Pat. No. 5,156,539, the disclosure of which is hereby incorporated herein by reference. Non-orbiting scroll member 24 is designed to be mounted to bearing housing 16 in a suitable manner to allow limited axial movement such as disclosed in U.S. Pat. No. 4,877,382 or U.S. Pat. No. 5,102,316 both disclosures of which are hereby incorporated herein by reference.

A steel drive shaft or crankshaft 80 having an eccentric crank pin 82 at one end thereof is rotatably journaled in a sleeve bearing 84 in main bearing housing 16 and a roller bearing 86 in lower bearing assembly 20. Crank pin 82 is drivingly disposed within inner bore 68 of drive bushing 66. Crank pin 82 has a flat on one surface which drivingly engages a flat surface (not shown) formed in a portion of bore 68 to provide a radially compliant drive arrangement, such as shown in assignee's aforementioned U.S. Pat. No. 4,877,382. Crankshaft 80 includes an axially extending bore 88 which intersects with a radial inlet bore 90 and a radial outlet bore 92 as will be described later herein. The end of crankshaft 80 opposite to crank pin 82 extends through lower bearing assembly 20 and is adapted to be connected to the power unit being used to drive shaft 80.

Oil pump assembly 18 is disposed within chamber 34 in concentric relationship to drive shaft 80. Oil pump assembly 18 comprises a housing 94, a pump body 96, a drive member 98 and a plurality of vanes 100. Housing 94 is secured to compressor body 12 using a plurality of bolts. Housing 94 defines an oil inlet passage 104 and an oil outlet passage 106. Pump body 96 is secured to housing 94 using a plurality of bolts arid thus pump body 96 is stationary. Pump body 96 defines a pumping chamber 110 within which the plurality of vanes 100 are located. Drive member 98 is drivingly secured to drive shaft 80 such that rotation of drive shaft 80 causes rotation of drive member 98. Vanes 100, four in the preferred embodiment, are disposed within chamber 110 and within pockets 112 located within drive member 98. Rotation of drive shaft 80 causes rotation of drive member 98 which in turn cause rotation of vanes 100 in pumping chamber 110 and the pumping of oil between inlet passage 104 which is in communication with a supply passage 114 which extends through compressor body 12 and which is in communication with an oil sump 116 located within sealed chamber 34 through a filter 118. Outlet passage 106 is in communication with a supply passage 120 which extends through compressor body 12 and is in communication with a filter chamber 122 formed by compressor body 12. An oil filter 124 is disposed within chamber 122 and chamber 122 is closed by a filter cap 126 which is secure to compressor body 12 using a plurality of bolts. Oil filter 124 is located between supply passage 120 and a return passage 130 which leads back to oil sump 116. A spring 132 biases oil filter 124 away from filter cap 126 to ensure oil flows through filter 124 before entering return passage 130. Return passage 130 is a stepped diameter passage which restricts oil flow to increase the oil pressure thereby providing oil to the moving components of compressor 10 as detailed below. The restricting of return passage 130 operates to control the amount of oil which is circulated through compressor 10. The amount of circulated oil is critical to the overall operation of compressor 10. Thus, oil pump assembly 18 pumps oil form oil sump 116 through supply passage 114, through inlet passage 104, through pumping chamber 110, out through outlet passage 106, through supply passage 120 and into filter chamber 122. From filter chamber 122 oil passes through oil filter 124 and back to oil sump 116 through return passage 130 with oil filter 124 removing debris from within the oil. Oil filter 124 can easily be changed by removing the bolts and cap 126 to gain access to oil filter 124.

Lower bearing assembly 20 comprises roller bearing 86 and a bearing cover 138. Roller bearing 86 is disposed between drive shaft 80 and housing 94 of oil pump assembly 18. A snap ring 140 positions the inner race of bearing 86 while the outer race is retained by bearing cover 138. Bearing cover 138 is secured to compressor body 12 using a plurality of bolts. A bearing spacer 144 and a Belville spring 146 are positioned between cover 138 and the outer race of bearing 136 to properly locate bearing 136. Bearing cover 138 defines an internal bore 148 having a plurality of circumferentially spaced radially inwardly extending ribs which position a spacer 150 and a plurality of seals 152 disposed between drive shaft 80 and bearing cover 138. Bearing cover 138 defines a radially extending oil passage 154 which places internal bore 148 in fluid communication with supply passage 120 in compressor body 12. In addition, inlet bore 90 of crankshaft 80 is in fluid communication with internal bore 148. Thus, in addition to oil pump assembly 18 supplying oil to filter chamber 122 through supply passage 120, a portion of the oil in supply passage 120 is directed through passage 154 and into internal bore 148 to lubricate seals 152 as well as bearing 86. A return passage 156 is provided in housing 94 of oil pump assembly 18 to return oil from bearing 136 to oil sump 116. A portion of the oil which is delivered to internal bore 148 enters inlet bore 90 in drive shaft 80, into axial extending bore 88 and out outlet bore 92 as well as out the axial end of drive shaft 80 through bore 88. The fluid which is directed out of outlet bore 92 lubricates bearing 84 in bearing housing 16 and the fluid exiting the end of bore 88 lubricates journal bearing 64 and drive bushing 66 located within cylindrical hub 62. The oil which lubricates bearing 84 as well as the oil that lubricates bearing 64 and bushing 66 returns to oil sump 116 by being directed to a chamber 158 formed by main bearing housing 16. Chamber 158 is in communication with oil sump 116 located within compressor body 12.

Thus, oil pump assembly 18 which is located centrally with respect to drive shaft 80 pumps oil to all functional area of compressor 10 as well as through a filtering system to continuously remove contaminates and debris from the cooling oil. Oil pump assembly 18 removes oil from sump 116 and distributes it throughout compressor 10. A first baffle 162 is located within oil sump 116 and operates to isolate oil sump 116 from the remainder of internal cavity 26, to isolate oil sump 116 from the rotational motion of a counterweight 164 secured to drive shaft 80 and to isolate counterweight 164 and from oil being returned to sump 116. By isolating oil sump 116 in this manner, oil stirring and foaming of the oil is significantly reduced. The reduction in oil stirring and reduction in foaming of the oil permits counterweight 164 to rotate freely within internal cavity 26 and reduces the power requirement for compressor 10 by as much as 10%. In addition, the amount of oil mist contained within sealed chamber 34 will be reduced. A second baffle 166 is located between main bearing housing 16 and compressor body 12. Baffle 166 isolates the portion of internal cavity 26 which houses scroll members 22 and 24 and main bearing housing 16 from the portion of internal cavity 26 which houses oil sump 116. The separation of these two portions of internal cavity 26 significantly reduces the oil integration in the suction port of scroll members 22 and 24 again increasing the operating efficiency of compressor 10.

Figure 2:
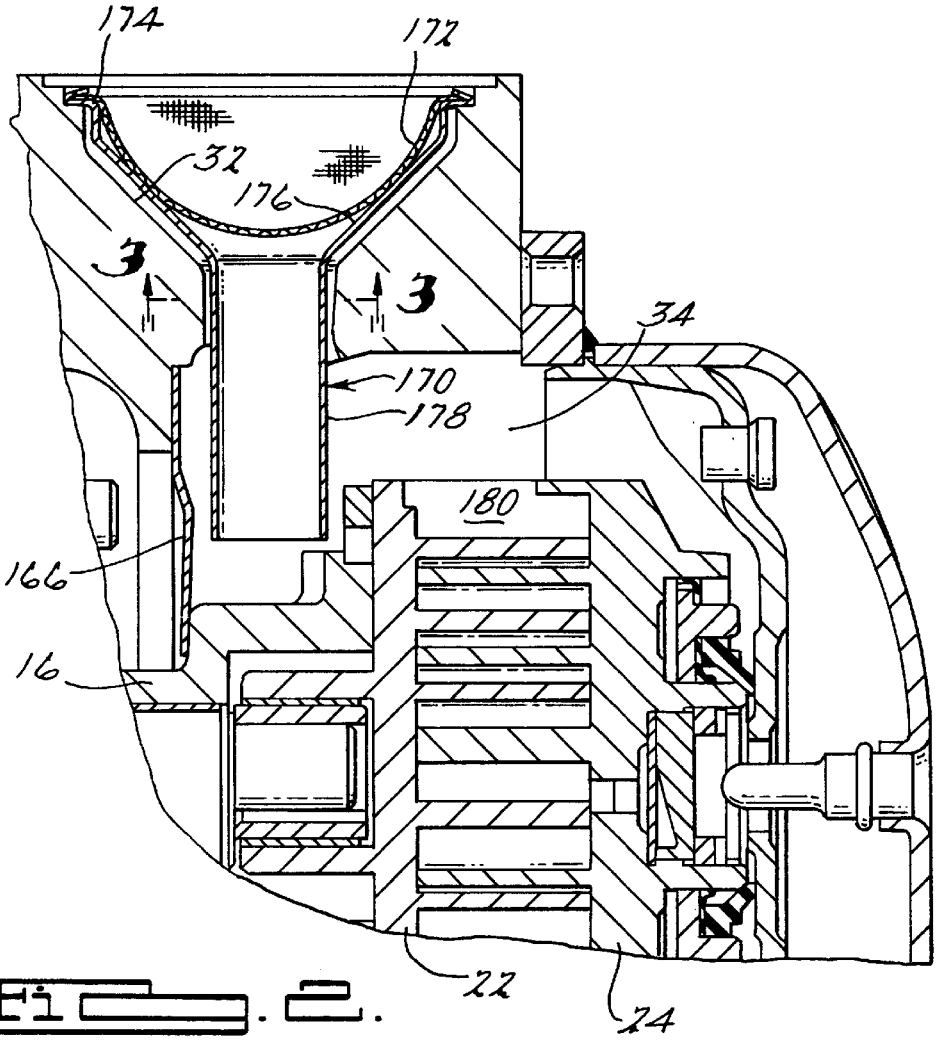
FIG. 2 is an enlarged view of the suction inlet for the compressor shown in FIG. 1.
Figure 3:
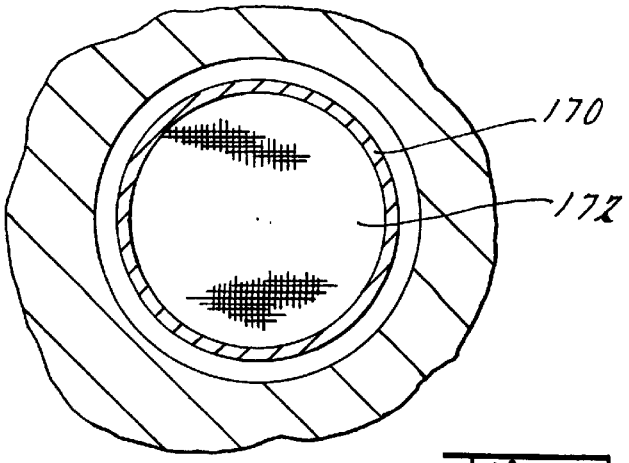
FIG. 3 is an end view of the screen and funnel assembly taken in the direction of arrows 3—3 in FIG. 1.

Referring now to FIG. 2, located within suction inlet 32 is a funnel 170 and located within funnel 170 is a generally spherical fine mesh screen 172. Funnel 170 includes an enlarged entry portion 174 which is connected to a tapered section 176 which leads to a generally circular cylindrical section 178. Generally cylindrical section 178 extends radially inward with respect to scroll members 22 and 24 to a position adjacent stationary main bearing housing 16. At this position adjacent main bearing housing 16, the outlet end of section 178 is positioned radially inward from a suction inlet port 180 defined by scroll members 22 and 24. Thus, working fluid being returned to sealed chamber 34 through suction inlet 32 passes through generally spherical fine mesh screen 172. The impact of the working fluid with screen 172 causes lubricant entrained within the working fluid to adhere to screen 172. As the working fluid travels through tapered section 176 and cylindrical section 178 the contact between the working fluid and funnel 170 will cause additional lubricant to adhere to funnel 170. The lubricant gathered by screen 172 will combine with the lubricant gathered by funnel 170 and will move radially inward towards main bearing housing 16 due to gravity and the flow of working fluid through funnel 170. Finally, the working fluid exiting funnel 170 will impact the outer surface of main bearing housing 16 further removing lubricant from the working fluid with the lubricant adhering to main bearing housing 16. The lubricant removed form the working fluid will return to sump 116. The lubrication removal system of the present invention is protected from the rotating motion of counterweight 164 by baffles 162 and 166. The working fluid with the lubricant removed will dispense within sealed chamber 34 until it is once again drawn into suction inlet port 180 defined by scrolls 22 and 24.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a compressor housing defining a chamber;

a partition separating said chamber into a suction chamber and a discharge chamber;

a stationary housing suction inlet extending through said compressor housing into said suction chamber;

a first scroll member disposed within said suction chamber, said first scroll member having a first spiral wrap;

a second scroll member disposed within said suction chamber, said second scroll member having a second spiral wrap intermeshed with said first spiral wrap;

a drive shaft disposed within said suction chamber and rotatably supported with respect to said compressor housing, said drive shaft receiving rotational input and transferring said rotational input to one of said scroll members for causing said scroll members to orbit relative to one another whereby said spiral wraps will create pockets of progressively changing volume from said suction chamber to said discharge chamber; and a lubricant removal system disposed within said housing suction inlet, said lubricant removal system comprising a stationary funnel disposed within said housing suction inlet, said funnel including a portion extending into said suction chamber.

2. The scroll machine according to claim 1, wherein said first and second scroll members define a scroll suction inlet, said portion of said funnel extending into said suction chamber to a position radially inward from said scroll suction inlet.

3. The scroll machine according to claim 1, wherein said first and second scroll members are supported by a bearing housing disposed within said suction chamber, said portion of said sunnel extending into said suction chamber to a position adjacent said bearing housing.

4. The scroll machine according to claim 3, wherein said first and second scroll members define a scroll suction inlet, said position adjacent said bearing housing being located radially inward from said scroll suction inlet.

5. The scroll machine according to claim 4, wherein said lubricant removal system further comprises a screen disposed within said housing suction inlet.

6. The scroll machine according to claim 5, wherein said screen is a generally spherical screen.

7. A scroll machine comprising:

a compressor housing defining a chamber;

a partition separating said chamber into a suction chamber and a discharge chamber;

a stationary housing suction inlet extending through said compressor housing into said suction chamber;

a first scroll member disposed within said suction chamber, said first scroll member having a first spiral wrap;

a second scroll member disposed within said suction chamber, said second scroll member having a second spiral wrap intermeshed with said first spiral wrap, said first and second scroll members defining a scroll suction inlet;

a drive shaft disposed within said suction chamber and rotatably supported about an axis by said compressor housing, said drive shaft receiving rotational input and transferring said rotational input to one of said scroll members for causing said scroll members to orbit relative to one another whereby said spiral wraps will create pockets of progressively changing volume from said suction chamber to said discharge chamber; and a stationary funnel disposed within said housing suction inlet, said funnel including a portion extending into said suction chamber to a first radial distance from said axis of said drive shaft, said scroll suction inlet being located at a second radial from said axis of said drive shaft, said second radial distance being greater than said first radial distance.

8. The scroll machine according to claim 7, wherein said first and second scroll members are supported by a bearing housing disposed within said suction chamber, said portion extending into said suction chamber to said first radial distance disposed adjacent said bearing housing.

9. The scroll machine according to claim 7, further comprising a screen disposed within said housing suction inlet.

10. The scroll machine according to claim 9, wherein said screen is a generally spherical screen.

* * * * *

UNITED STATES PATENT AND TRADEMARK OFFICE

CERTIFICATE OF CORRECTION

PATENT NO. : 6,315,536 B1
DATED : November 13, 2001
INVENTOR(S) : Todd DeVore and Jeff Huddleston It is certified that error appears in the above-identified patent and that said Letters Patent is hereby corrected as shown below:

Column 3,
Line 18, “member” should be -- members --.
Line 21, “Adaptor” should be -- Adapter --.
Line 23, “adaptor” should be -- adapter --.

Column 4,
Line 29, “arid” should be -- and --.
Line 47, “secure” should be -- secured --.
Line 59, “form” should be -- from --.

Column 5,
Line 7, “Belville” should be -- Bellville --.
Line 38, “area” should be -- areas --.

Column 6,
Line 22, “form” should be -- from --.

Column 7,
Line 2, “sunnel” should be -- funnel --.

Column 8,
Line 13, after “radial” insert -- distance --.
Line 20, after “distance” insert -- being --.

Signed and Sealed this

Twenty-eighth Day of January, 2003

JAMES E. ROGAN
*Director of the United States Patent and Trademark Office*